US008564524B2

(12) United States Patent
Tu et al.

(10) Patent No.: US 8,564,524 B2
(45) Date of Patent: Oct. 22, 2013

(54) SIGNAL CONTROLLING CIRCUIT, AND FLAT PANEL DISPLAY THEREOF

(75) Inventors: Chang-Ching Tu, Taipei County (TW); Yu-Chieh Fang, Kaohsiung (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1433 days.

(21) Appl. No.: 12/233,606

(22) Filed: Sep. 19, 2008

(65) Prior Publication Data

US 2009/0109197 A1 Apr. 30, 2009

(30) Foreign Application Priority Data

Oct. 31, 2007 (TW) ..... 96141056 A

(51) Int. Cl.
*G09G 3/36* (2006.01)

(52) U.S. Cl.
USPC ..... 345/100

(58) Field of Classification Search
USPC ..... 345/87–104
See application file for complete search history.

(56) References Cited

U.S. PATENT DOCUMENTS

| | | | | |
|---|---|---|---|---|
| 6,335,715 | B1 | 1/2002 | Lee | |
| 2001/0000421 | A1 * | 4/2001 | Ge | 313/493 |
| 2006/0038538 | A1 * | 2/2006 | Inoue et al. | 320/157 |

* cited by examiner

*Primary Examiner* — Sumati Lefkowitz
*Assistant Examiner* — Robert E Carter, III
(74) *Attorney, Agent, or Firm* — Jianq Chyun IP Office

(57) ABSTRACT

A flat panel display comprises a display panel, a scan driving circuit and a control unit, wherein the display panel includes a plurality of scan lines. The scan driving circuit generates the first and the second scan signals to enable a portion of the scan lines. Furthermore, the control unit may enable a control signal every a predetermined duration according to these scan lines.

24 Claims, 8 Drawing Sheets

SIGNAL CONTROLLING CIRCUIT, AND FLAT PANEL DISPLAY THEREOF

CROSS-REFERENCE TO RELATED APPLICATION

This application claims the priority benefit of Taiwan application serial no. 96141056, filed on Oct. 31, 2007. The entirety of the above-mentioned patent application is hereby incorporated by reference herein and made a part of specification.

BACKGROUND OF THE INVENTION

1. Field of the Invention

The present invention relates to a flat panel display. More particularly, the present invention relates to a flat panel display which is not influenced by RC delay.

2. Description of Related Art

A conventional display panel includes a plurality of pixels arranged in an array. However, if parasitic resistance and parasitic capacitance of each pixel is simplified as a first-order low-pass filter circuit with an equivalent resistor and an equivalent capacitor, a scan line coupled to a plurality of the pixels then may be regarded as a series of low-pass filters. Therefore, when an enabled scan signal passes through the low-pass filters, a high-frequency signal may be gradually declined, such that waveform of the scan signal transmitted to the final low-pass filter may be different from that transmitted to the first low-pass filter.

FIG. 1 is a waveform diagram of a conventional scan signal. When scan signals $V_1$ and $V_2$ are input to a display panel, waveforms of the scan signals $V_1$ and $V_2$ may be as that shown in FIG. 1(*a*); and when scan signals $V_1'$ and $V_2'$ are output from the display panel, the waveforms of the scan signals $V_1'$ and $V_2'$ may be as that shown in FIG. 1(*b*). In FIG. 1(*a*), the scan signals $V_1$ and $V_2$ are not influenced by RC delay, and rising edges and falling edges of the scan signals $V_1$ and $V_2$ are transient.

Referring to FIG. 1(*b*), it is obvious that the scan signals $V_1'$ and $V_2'$ all have the RC delay, especially the falling edges of the scan signals $V_1'$ and $V_2'$ are obviously prolonged. Moreover, during a time interval of t2, since the scan signals $V_1'$ and $V_2'$ are influenced by the RC delay, the scan signals $V_1'$ and $V_2'$ are both enabled.

FIG. 2 is a waveform diagram illustrating a conventional method of intervening scan signals with a control signal. Referring to FIG. 2, to solve the above problem, a control signal OE is provided, and is used for intervening the rising edge and the falling edge of the scan signals of two adjacent rows. When the control signal OE is enabled, each of the scan signals has a low voltage level, and therefore enable time of the control signal OE is important. If the enable time of the control signal OE is too short, the scan signals are then influenced by the RC delay, such that the scan signals of the two adjacent rows may be simultaneously enabled, which may cause a problem that data may be repeatedly written on the pixels. When the enable time of the control signal OE is too long, though repeat writing of data on the pixels is avoided, charging time of the scan line is wasted, which may cause insufficient charging of the pixels.

SUMMARY OF THE INVENTION

Accordingly, the present invention is directed to a flat panel display and a signal controlling circuit thereof, by which repeat writing of data on pixels may be avoided, and each scan signal may have a sufficient charging time.

According to another aspect of the present invention, the present invention is directed to a controlling method for a flat panel display, by which scan signals of two adjacent rows may not be enabled simultaneously.

The present invention provides a signal controlling circuit for controlling a display panel, in which a plurality of scan lines is sequentially disposed on the display panel for respectively receiving a corresponding scan signal. The signal controlling circuit includes a first comparison feedback unit, a second comparison feedback unit and a calculation unit. The first comparison feedback unit is coupled to two of the plurality of scan lines for receiving the corresponding scan signals and outputting a first calculation signal. The second comparison feedback unit is coupled to one of the plurality of scan lines other than those coupled to the first comparison feedback unit for receiving the corresponding scan signal and outputting a second calculation signal. Moreover, the calculation unit is used for receiving the first calculation signal and the second calculation signal for determining whether or not to enable a control signal every a predetermined time interval, wherein when the control signal is enabled, one of the plurality of scan signals is enabled.

According to still another aspect of the present invention, the present invention provides a flat panel display including a display panel, a scan driving circuit and a control unit, wherein the display panel includes a plurality of scan lines. The scan driving circuit is coupled to the display panel for generating a first and a second scan signals. The first scan signal enables two of the plurality of scan lines, and the second scan signal enables one of the plurality of scan lines other than the two scan lines enabled by the first scan signal. Furthermore, the control unit is used for receiving the plurality of scan signals for determining whether or not to enable a control signal every a predetermined time interval according to these scan signals, wherein when the control signal is enabled, one of the scan signals is then enabled.

According to yet another aspect of the present invention, the present invention provides a controlling method for a flat panel display, by which N scan lines are sequentially disposed on the flat panel display, and N is a positive integer. The controlling method for the flat panel display is as follows. First, a first scan signal and a second scan signal are circularly generated, wherein the first scan signal is used for enabling scan signals on a M-th scan line and a (M+1)-th scan line within the N scan lines, the second scan signal is used for enabling the scan signals on the other scan lines, and M is a positive integer less than N. Next, a setting time is selected, and the setting time is a time interval during when level of the scan signal of the M-th scan line being greater than a threshold voltage and when the level of the scan signal of the (M+1)-th scan line being greater than the threshold voltage, wherein the threshold voltage is a minimum voltage required for enabling each of the scan lines. Moreover, during the second scan signal being generated, the second scan signal is enabled every the setting time for sequentially enabling the corresponding scan line.

The flat panel display of the present invention includes a display panel, a scan driving circuit and a control unit. Wherein, cycle of the second scan signal may be adjusted according to the control signal generated by the control unit, such that scan signals of the two adjacent rows may not be enabled simultaneously. Therefore, repeat writing of data on the pixels of the display penal is avoided.

In order to make the aforementioned and other objects, features and advantages of the present invention comprehensible, a preferred embodiment accompanied with figures is described in detail below.

DESCRIPTION OF EMBODIMENTS

Figure 3:
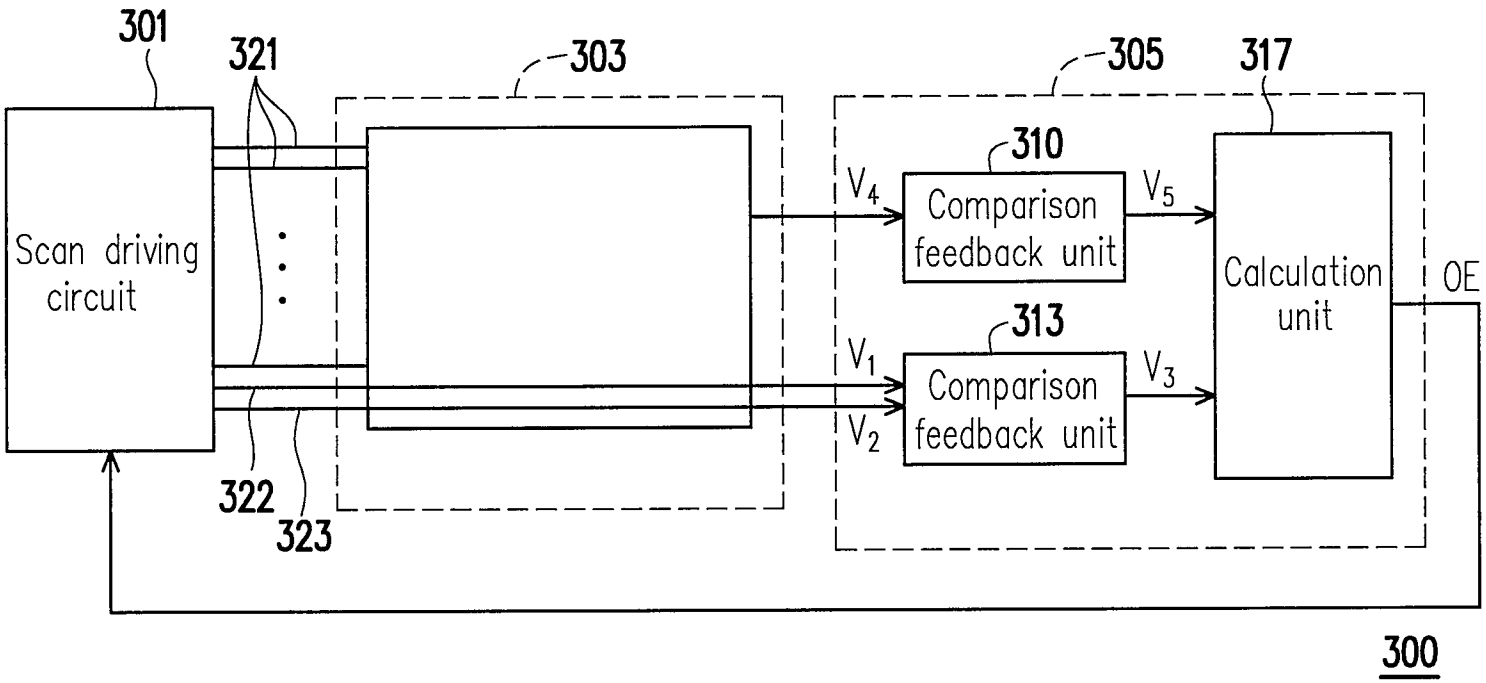
FIG. 3 is a circuit diagram of a flat panel display according to an exemplary embodiment of the present invention.

FIG. 3 is a circuit diagram of a flat panel display according to an exemplary embodiment of the present invention. Referring FIG. 3, a flat panel display 300 includes a display panel 303, a scan driving circuit 301 and a control unit 305. The scan driving circuit 301 is coupled to one end of the display panel 303 via a plurality of scan lines 321~323, and the control unit 305 is coupled to the other end of the display panel 303.

The display panel 303 may be a liquid crystal display (LCD) panel. It is known that besides the scan lines, the flat panel display further includes a plurality of data lines disposed vertically to the scan lines and a plurality of pixel units disposed on crosspoints of the scan lines and the data lines. To avoid confusion of the spirit of the present invention, these devices are not disclosed in the present embodiment. However, it should be understood by those skill in the art that other devices may be included within the display panel 303, though description thereof is omitted.

Particularly, the scan driving circuit 301 may generate a first scan signal and a second scan signal. Wherein, the first scan signal is used for driving two of the scan lines coupled to the scan driving circuit 301, for example, the first scan signal may enable the pixel units on the scan lines 322 and 323. The second scan signal is used for driving one of the scan lines 321. In the present embodiment, the scan lines 322 and 323 may be the scan lines at two last rows of the display panel 303.

Referring to FIG. 3 again, the control unit 305 includes comparison feedback units 310 and 313, and a calculation unit 317. Wherein, the comparison feedback unit 313 receives scan signals $V_1$ and $V_2$ passing through the display panel 303 from the scan lines 322 and 323, and generates a calculation signal $V_3$. The comparison feedback unit 310 receives a scan signal $V_4$ passing through the display panel 303 from one of the scan lines 321, and generates a calculation signal $V_5$. The calculation unit 317 enables a control signal OE every a predetermined time interval according to the calculation signals $V_3$ and $V_5$. When the control signal OE is enabled, the scan driving circuit 301 may output the first scan signal to one of the scan lines 321 to enable the pixel units thereon.

Figure 4:
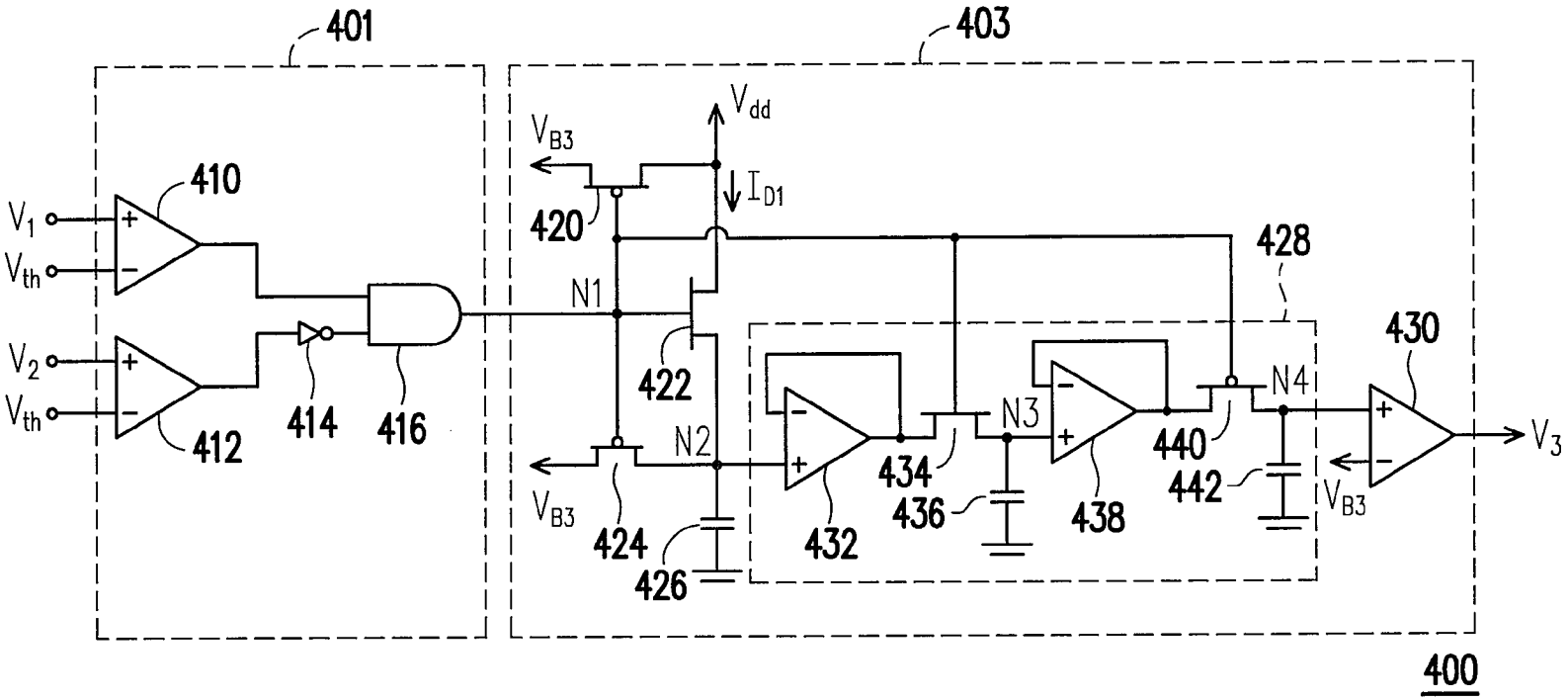
FIG. 4 is circuit diagram illustrating a comparison feedback unit according to an exemplary embodiment of the present invention.

FIG. 4 is circuit diagram illustrating a comparison feedback unit 400 according to an exemplary embodiment of the present invention. The comparison feedback unit 400 may be the comparison feedback unit 313 of FIG. 3. In the present embodiment, the comparison feedback unit 400 includes a logic circuit 401 and a buffer amplifier module 403. Wherein, the logic circuit 401 includes comparators 410 and 412, an inverter 414 and an AND gate 416.

In the comparison feedback unit 400, a positive input terminal of the comparator 410 receives the scan signal $V_1$, and a negative input terminal thereof receives a threshold voltage $V_{th}$. Moreover, the positive input terminal of the comparator 412 receives the scan signal $V_2$, and the negative input terminal thereof also receives the threshold voltage $V_{th}$. Accordingly, the comparators 410 and 412 may output a first comparison signal and a second comparison signal according to the potential of the positive input terminal and the negative input terminal thereon.

In addition, an output terminal of the comparator 412 is further coupled to the inverter 414 to generate an inverted second comparison signal. An output terminal of the inverter 414 is coupled to one end of the AND gate 416 for transmitting the inverted second comparison signal to the AND gate 416. The other end of the AND gate 416 is coupled to an output terminal of the comparator 410 for receiving the first comparison signal. By such means, the AND gate 416 may output a logic signal to the buffer amplifier module 403 according to the first comparison signal and the inverted second comparison signal.

The buffer amplifier module 403 includes transistors 420, 422 and 424, a capacitor 426, a buffer amplifying circuit 428 and an operational amplifier 430. In the present embodiment, a gate of the transistor 422 is coupled to the output terminal of the AND gate 416 for receiving the logic signal. Moreover, a first source/drain of the transistor 422 receives a voltage source $V_{dd}$, and a second source/drain of the transistor 422 is coupled to the ground via the capacitor 426, and is coupled to the buffer amplifying circuit 428. On the other hand, the first sources/drains of the transistors 420 and 424 commonly receive a voltage signal $V_{B3}$, and the gates of the transistors 420 and 424 are commonly coupled to the gate of the transistor 422. The second sources/drains of the transistors 420 and 424 are respectively coupled to the first source/drain and the second source/drain of the transistor 422.

In the present embodiment, the operational amplifier 430 may be a low gain amplifier with a positive input terminal coupled to the buffer amplifying circuit 428, and a negative input terminal receives the voltage signal $V_{B3}$. Accordingly, the operational amplifier 430 may output the calculation signal $V_3$.

Referring to FIG. 4 again, the buffer amplifying circuit 428 includes buffer amplifiers 432 and 438, transistors 434 and 440, capacitors 436 and 442. A negative input terminal and an output terminal of the buffer amplifier 432 are connected to one another, and a positive input terminal of the buffer amplifier 432 is coupled to the second source/drain of the transistor 422. Moreover, the first source/drain of the transistor 434 is coupled to the output terminal of the buffer amplifier 432, the second source/drain of the transistor 434 is coupled to the ground via the capacitor 436, and the gate of the transistor 434 is coupled to the gate of the transistor 422.

Similarly, the negative input terminal and the output terminal of the buffer amplifier 438 are also coupled one another, and the positive input terminal thereof is coupled to the second source/drain of the transistor 434. Moreover, the first source/drain of the transistor 440 is coupled to the output terminal of the buffer amplifier 438, and the second source/drain of the transistor 440 is coupled to the ground via the capacitor 442, and is coupled to the positive input terminal of the operational amplifier 430. Moreover, the gate of the transistor 440 is also coupled to the gate of the transistor 434. In the present embodiment, the transistors 422 and 434 may be the NMOS transistors, and the transistors 420, 424 and 440 may be the PMOS transistors.

Figure 1:
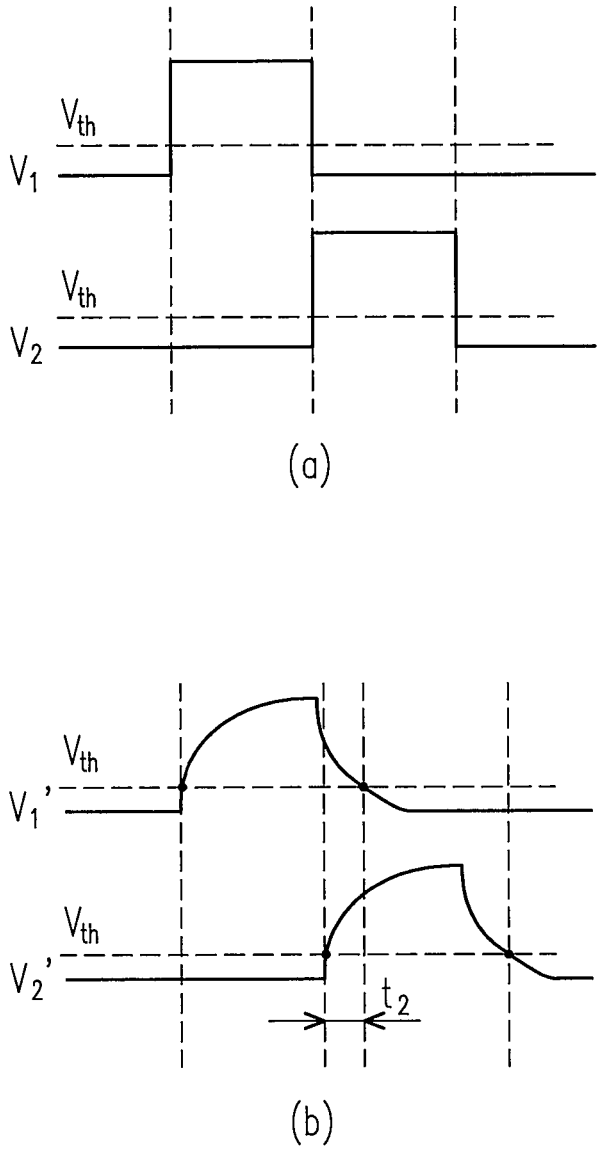
FIG. 1 is a waveform diagram of a conventional scan signal.
Figure 2:
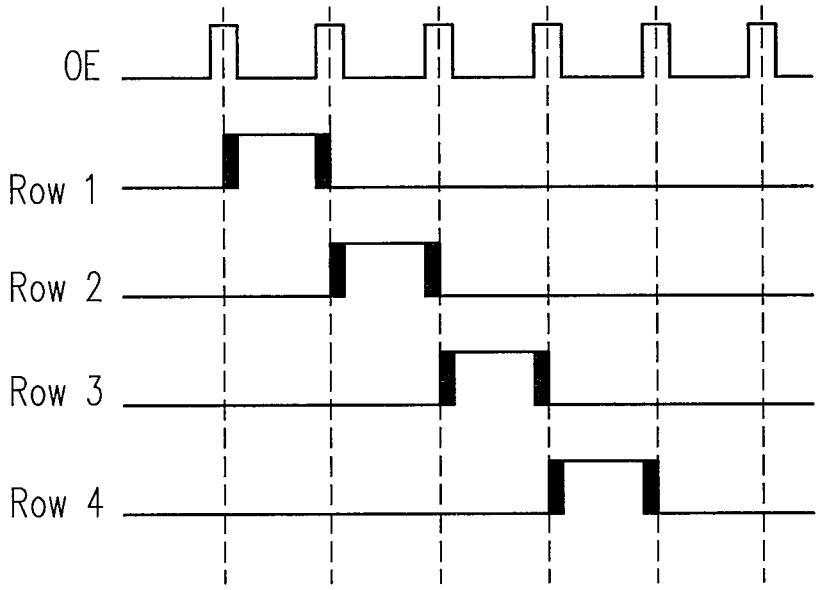
FIG. 2 is a waveform diagram illustrating a conventional method of intervening scan signals with a control signal.
Figure 5:
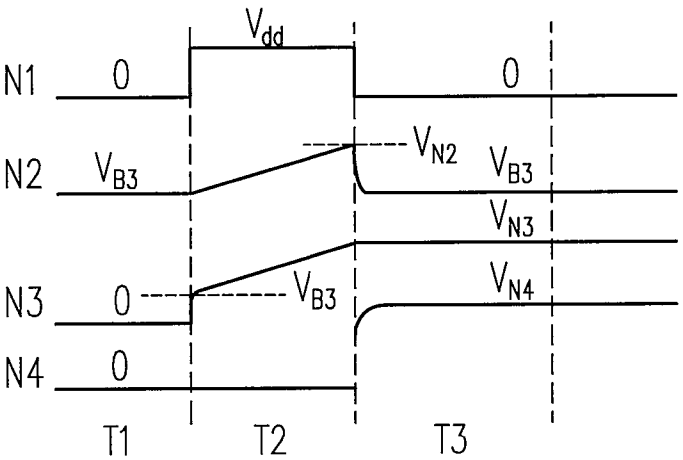
FIG. 5 is a timing diagram of node voltages of a buffer amplifier module of FIG. 4.

FIG. 5 is a timing diagram of node voltages of the buffer amplifier module 403 of FIG. 4. Referring to FIG. 1, FIG. 4 and FIG. 5, during a time interval T1, when the scan signals $V_1$ and $V_2$ are all less than the threshold voltage, the first comparison signal and the second comparison signal generated by the comparators 410 and 412 all have a low voltage level. Now, one input terminal of the AND gate 416 receives the first comparison signal with the low voltage level, and the other input terminal of the AND gate 416 receives the inverted second comparison signal (with high voltage level). Now, the AND gate 416 may output the logic signal with the low voltage level, such that a node N1 has the low voltage level. In this case, the transistors 422 and 434 are turned off, and the transistors 420, 424 and 440 are turned on, such that the voltage signal $V_{B3}$ is transmitted to the first source/drain and the second source/drain of the transistor 422, and the voltage level of a node N2 may be $V_{B3}$.

During a time interval T2, when the scan signal $V_1$ is transited and is higher than the threshold voltage $V_{th}$, the comparator 410 may generate the first comparison signal with a high level for the AND gate 416, such that the AND gate 416 may output the logic signal with the high voltage level. Now, the transistors 420, 424 and 440 are all turned off, the transistors 422 and 434 are turned on, and a working current $I_{D1}$ is generated and flowed through the transistor 422 for charging the capacitor 426. Therefore, the voltage level of the node N2 may be gradually increased from the level $V_{B3}$. On the other hand, when the transistor 434 is turned on, the capacitor 436 is charged, and the voltage level of a node N3 may be elevated to $V_{B3}$, meanwhile, the voltage level of the node N3 may also be increased along with the voltage level of the node N2. Now, a node voltage $V_{N2}$ of the node N2 and a node voltage $V_{N3}$ of the node N3 may be represent by a following equation:

$$V_{N2}=V_{N3}=V_{B3}+I_{D1}\times t_x/C1$$

Wherein, $t_x$ is a time interval when the scan signal being greater than the threshold voltage $V_{th}$. In another word, the $t_x$ is length of the time interval T2. In addition, C1 is a capacitance of the capacitor 426.

Next, during the time interval T3, the level of the scan signal $V_1$ may be pulled down to be lower than the threshold voltage $V_{th}$, and therefore the comparator 410 may output the first comparison signal with the low voltage level. On the other hand, the level of the scan signal $V_2$ is transited, and is higher than the threshold voltage, such that the comparator 412 may output the first comparison signal with the high voltage level, so that an output of the inverter 414 may have the low voltage level. Therefore, the AND gate 416 may output the logic signal with the low voltage level. Now, the transistors 422 and 434 are turned off, and the transistors 420, 424 and 440 are turned on. Thus, the voltage level of the node N2 is pulled back to $V_{B3}$, while the voltage level of the node N3 is maintained. Moreover, since the transistor 440 is turned on, a node voltage $V_{N4}$ of a node N4 may be momentarily increased, and an equation thereof is as follows.

$$V_{N4}=V_{N3}=V_{B3}+I_{D1}\times t3/C1$$

In the present embodiment, the operational amplifier 430 may be a low gain amplifier with a gain of A1, the positive input terminal of the operational amplifier 430 is coupled to the node N4, and the negative input terminal of the operational amplifier 430 receives the voltage signal $V_{B3}$. By such means, the operational amplifier 430 may generate the calculation signal $V_3$ according to the voltage level of the node N4 and the voltage signal $V_{B3}$. Wherein, the calculation signal $V_3$ may be represented by the following equation:

$$V_3=A1\times[(V_{B3}+I_{D1}\times t3/C1)-V_{B3}]=(A1\times I_{D1}/C1)\times t3 \quad (1)$$

Figure 6:
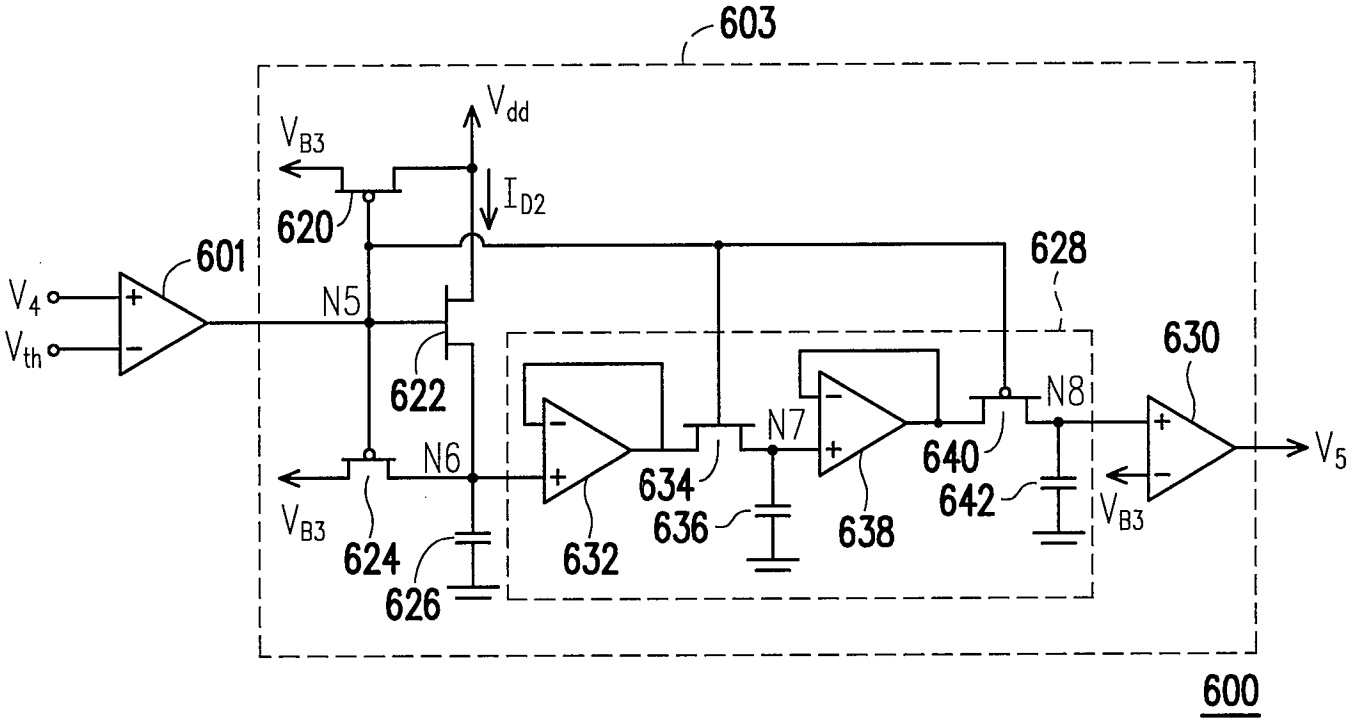
FIG. 6 is a circuit diagram of a comparison feedback unit according to an exemplary embodiment of the present invention.

FIG. 6 is a circuit diagram of a comparison feedback unit 600 according to an exemplary embodiment of the present invention. The comparison feedback unit 600 may be the comparison feedback unit 310 of FIG. 3. Referring to FIG. 6, the comparison feedback unit 600 includes a comparator 601 and a buffer amplifier module 603. The positive input terminal of the comparator 601 receives the scan signal $V_4$, the negative input terminal of the comparator 601 receives the threshold voltage $V_{th}$, and the output terminal thereof is coupled to the buffer amplifier module 603.

Similar to the buffer amplifier module 403 of FIG. 4, the buffer amplifier module 603 also includes transistors 620, 622 and 624, a capacitor 626, a buffer amplifying circuit 628 and a operational amplifier 630, and the coupling approach thereof may be referred to that of the transistors 420, 422 and 424, the capacitor 426, the buffer amplifying circuit 428 and the operational amplifier 430 within the buffer amplifier module 403.

In addition, the buffer amplifying circuit 628 includes buffer amplifiers 632 and 638, transistors 634 and 640, and capacitors 636 and 642, and the coupling approach thereof may be referred to that of the buffer amplifiers 432 and 438, transistors 434 and 440, and capacitors 436 and 442 within the buffer amplifying circuit 428 of FIG. 4.

Figure 7B:
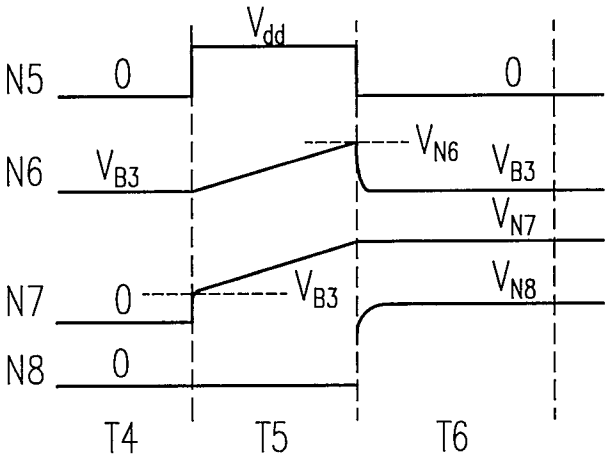
FIG. 7B is a timing diagram illustrating a voltage variation of nodes of a buffer amplifier module of FIG. 6.
Figure 7A:
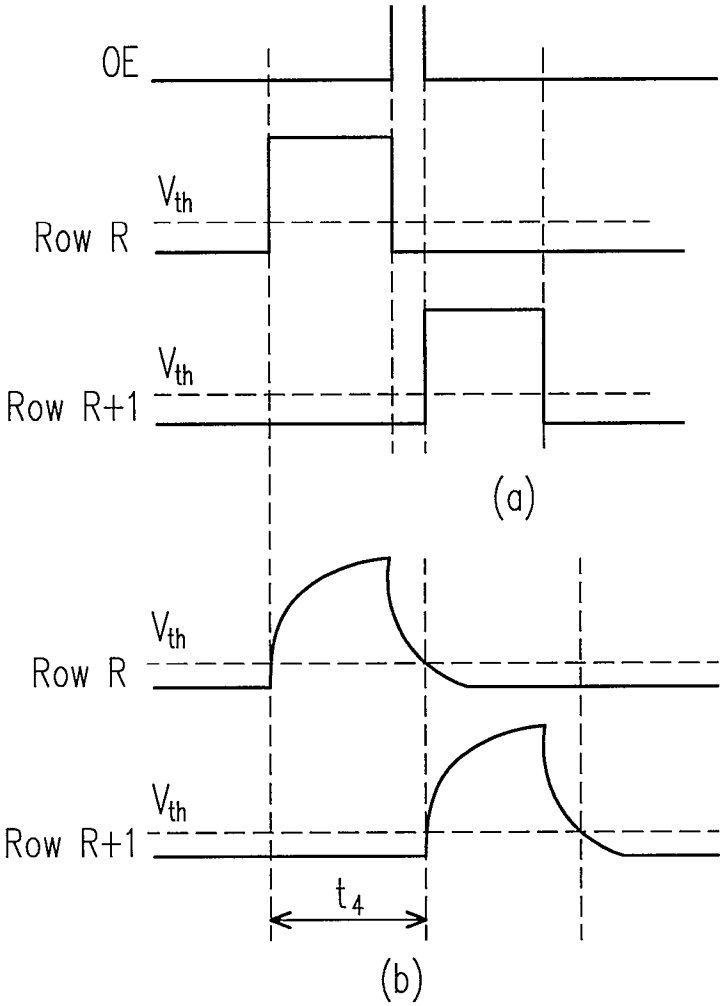
FIG. 7A is a waveform diagram of a scan signal.

FIG. 7A is a waveform diagram of the scan signal $V_4$. When the scan signal is input to the display panel, the waveform of the scan signal is shown as FIG. 7A(a), and when the scan signal is output from the display panel, the waveform of the scan signal is shown as FIG. 7A(b). At the rising edge of the control signal OE, a R-th row scan signal is transited from the high level to the low level. Correspondingly, at the falling edge of the control signal OE, a (R+1)-th row scan signal is transited from the low level to the high level, wherein R is a positive integer. So that, the adjacent scan lines may not be high level in the same time for avoiding the wrong operation.

FIG. 7B is a timing diagram illustrating a voltage variation of the nodes of the buffer amplifier module of FIG. 6. Referring to FIG. 6 and FIG. 7, during a time interval T4, the level of the scan signal $V_4$ is less than the threshold voltage $V_{th}$, and the comparator 601 outputs a third comparison signal with low voltage level to a node N5 of the buffer amplifier module 603. Now, the transistors 622 and 634 are turned off, and the transistors 620, 624 and 640 are turned on, such that the voltage signal $V_{B3}$ may be transmitted to the first source/drain and the second source/drain of the transistor 622, and the voltage level of a node N6 may be $V_{B3}$ accordingly.

During the time interval T5, the scan signal $V_4$ is transited and is higher than the threshold voltage $V_{th}$, and therefore the comparator 601 may output the third comparison signal with the high level to the node N5 of the buffer amplifier module 603. Now, the transistors 620, 624 and 640 are turned off, the transistors 622 and 634 are turned on, and the transistor 622 may generate a working current $I_{D2}$ for charging the capacitor 626. Therefore, the voltage level of a node N6 may be gradually increased from the level $V_{B3}$. Moreover, since the transistor 634 is turned on, and the moment the transistor 634 is turned on, the voltage level of a node N7 may be elevated to $V_{B3}$, meanwhile, the voltage level of the node N7 may also be increased along with the voltage level of the node N6. Now, a node voltage $V_{N6}$ of the node N6 and a node voltage $V_{N7}$ of the node N7 may be represent by a following equation:

$$V_{N6}=V_{N7}=V_{B3}+I_{D2}\times t_y/C2$$

Wherein $t_y$ is a time, in which the R-th row scan signal, i.e. the scan signal $V_4$ is greater than the threshold voltage $V_{th}$, and C2 is a capacitance of the capacitor 626.

During a time interval T6, the level of the scan signal $V_4$ is pulled down to be lower than the threshold voltage $V_{th}$, and therefore the comparator 601 may output the third comparison signal with the low voltage level to the node N5 of the buffer amplifier module 602. Now, the transistors 622 and 634 are turned off, and the transistors 620, 624 and 640 are turned on. Thus, the voltage level of the node N6 may be pulled back to $V_{B3}$, while the voltage level of the node N7 is maintained. Moreover, since the transistor 640 is turned on, the node voltage of a node N8 may be momentarily increased, and the node voltage $V_{N8}$ of the node N8 may be represented by a following equation:

$$V_{N8}=V_{N7}=V_{B3}+I_{D2}\times t4/C2$$

Similarly, the operational amplifier 630 may also be a low gain amplifier with a gain of A2. Moreover, the positive input terminal of the operational amplifier 630 is coupled to the node N4, and the negative input terminal of the operational amplifier 630 receives the voltage signal $V_{B3}$. By such means, the operational amplifier 630 may generate the calculation signal $V_5$ according to the voltage level of the node N4 and the voltage signal $V_{B3}$, which may be represented by the following equation:

$$V_5=A2\times[(V_{B3}+I_{D2}\times t4/C2)-V_{B3}]=(A2\times I_{D2}/C2)\times t4 \quad (2)$$

Figure 8:
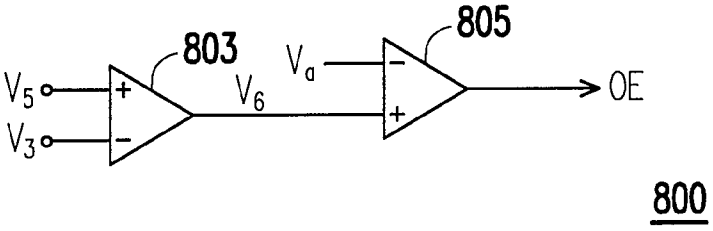
FIG. 8 is a circuit diagram of a calculation unit according to an exemplary embodiment of the present invention.

FIG. 8 is a circuit diagram of a calculation unit according to an exemplary embodiment of the present invention. The calculation unit of the present embodiment may be the calculation unit 317 of FIG. 3. The calculation unit 800 includes a operational amplifier 803 and a comparator 805. The positive input terminal of the operational amplifier 803 receives the calculation signal $V_5$, and the negative input terminal of the operational amplifier 803 receives calculation signal $V_3$. By such means, the operational amplifier 803 may output a calculation signal $V_6$.

In the present embodiment, since the operational amplifier 803 is a high gain amplifier, a virtual short circuit effect may be occurred, such that levels on the positive input terminal and the negative input terminal of the operational amplifier 803 are approximately the same, i.e. the equations (1) and (2) are equivalent, and a following equation is obtained.

$$V3=V5=(A1\times I_{D1}/C1)*t_x=(A2\times I_{D2}/C2)*t_y \quad (3)$$

According to the equation (3), when A1, $I_{D1}$, and C1 are equal to A2, $I_{D2}$, and C2 respectively, $t_y$ is equal to $t_x$, wherein the period t3 is an enable time without the control signal OE, and the period t4 is the enable time including the control signal OE. If the period t4 equals to the period t3, it represents the equivalent capacitor and the equivalent resistor on the scan line have sufficient time for discharging, and therefore the scan signals of the two adjacent rows will not be enabled simultaneously.

In addition, the comparator 805 of the present embodiment is a pulse width modulation comparator with the positive input terminal coupled to the output terminal of the comparator 803 for receiving the calculation signal $V_6$, and the negative input terminal of the comparator 805 may receive a triangle-wave signal $V_a$. Therefore, during a time interval when the voltage level of the calculation signal $V_6$ being greater than the voltage level of the triangle-wave signal, the comparator 805 outputs the control signal OE with the high voltage level. Conversely, when the voltage level of the calculation signal $V_6$ is less than the voltage level of the triangle-wave signal, the comparator 805 outputs the control signal OE with the low voltage level.

Figure 9:
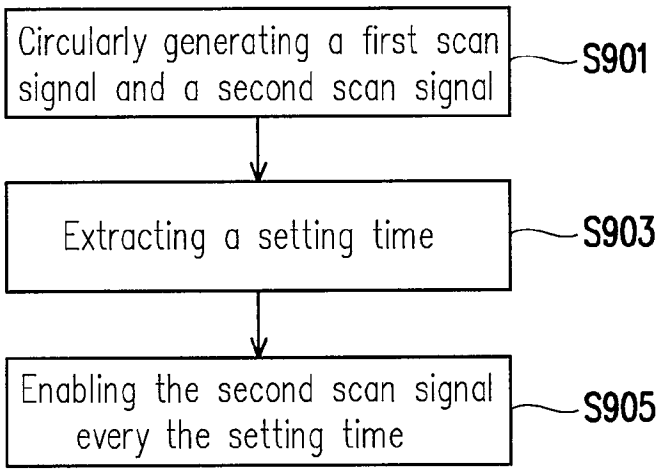
FIG. 9 is a flowchart illustrating a controlling method for a flat panel display according to an exemplary embodiment of the present invention.

FIG. 9 is a flowchart illustrating a controlling method for a flat panel display according to an exemplary embodiment of the present invention. Referring to FIG. 9, the flat panel display of the present invention has N scan lines, wherein N is a positive integer. The controlling method for the flat panel display includes the following steps. First, a first scan signal and a second scan signal are circularly generated (step S901).

The first scan signal is used for enabling scan signals on a M-th scan line and a (M+1)-th scan line within the N scan lines, and the second scan signal is used for enabling the scan signals on the scan lines other than the M-th scan line and the (M+1)-th scan line. In the present embodiment, the M-th scan line and the (M+1)-th scan line may be the last two scan lines on the display panel, and M is a positive integer less than N.

Next, a setting time is extracted (step S903), and the second scan signal is enabled every the setting time (step S905). When the second scan signal is enabled, only one scan line is enabled. When level of the scan signal of the M-th scan line being greater than a threshold voltage, the setting time is beginning, and when the level of the scan signal of the (M+1)-th scan line being greater than the threshold voltage, the setting time is stopping. Moreover, the threshold voltage is a minimum voltage required for enabling each of the scan lines.

In summary, the control signal is generated based on the buffer amplifier module and the calculation unit, and an enable cycle of the second scan signal is adjusted according to the control signal, such that the second scan signal may only enable one scan signal during the setting time. Therefore, RC delay of the scan signals on scan lines is solved by the present invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A signal controlling circuit, for controlling a display panel, wherein a plurality of scan lines is disposed on the display panel for respectively receiving a corresponding scan signal, and each of the scan lines is coupled to a plurality of the pixels disposed on the display panel, the signal controlling circuit comprising:

a first comparison feedback unit, coupled to two of the scan lines, for receiving the corresponding scan signals and outputting a first calculation signal, wherein the first comparison feedback unit comprises:

a logic circuit, for receiving two of the scan signals and outputting a logic signal; and a buffer amplifier module, coupled to the logic circuit, for receiving the logic signal and generating the first calculation signal, wherein the buffer amplifier module comprises:

a first transistor, having a first source/drain receiving a voltage source and a gate receiving the logic signal;

a second transistor, having a first source/drain and a second source/drain respectively receiving a voltage signal and the voltage source, and a gate coupled to the gate of the first transistor;

a third transistor, having a first source/drain receiving the voltage signal, a gate and a second source/drain respectively coupled to the gate and a second source/drain of the first transistor;

a first capacitor, having one end coupled to the second source/drain of the first transistor and another end coupled to the ground;

a first operational amplifier, having a positive input terminal coupled to the second source/drain of the first transistor and a negative input terminal receiving the voltage signal; and a buffer amplifying circuit, disposed between the first transistor and the first operational amplifier, for delaying transmitting time of signals;

a second comparison feedback unit, coupled to one of the scan lines other than the two scan lines coupled to the first comparison feedback unit, for receiving the corresponding scan signal and outputting a second calculation signal; and a calculation unit, for receiving the first calculation signal and the second calculation signal, and determining whether or not to enable a control signal every a predetermined time, wherein when the control signal is enabled, one of the scan lines is enabled.

2. The signal controlling circuit as claimed in claim 1, wherein the first comparison feedback unit is coupled to last two rows of the scan lines.

3. The signal controlling circuit as claimed in claim 1, wherein the control signal enables scan signal on the scan line coupled to the second comparison feedback unit.

4. The signal controlling circuit as claimed in claim 1, wherein the logic circuit comprises:

a first comparator, having a positive input terminal receiving one of the scan signals and a negative input terminal receiving a threshold voltage, and configured to outputting a first comparison signal;

a second comparator, having a positive input terminal receiving the other one of the scan signals and a negative input terminal receiving the threshold voltage, and configured to outputting a second comparison signal;

an inverter, coupled to an output terminal of the second comparator, for outputting an inverted second comparison signal; and an AND gate, outputting the logic signal to the buffer amplifier module according to the first comparison signal and the inverted second comparison signal.

5. The signal controlling circuit as claimed in claim 1, wherein the first operational amplifier is a low gain amplifier.

6. The signal controlling circuit as claimed in claim 1, wherein the first transistor is an NMOS transistor, and the second transistor and the third transistor are PMOS transistors.

7. The signal controlling circuit as claimed in claim 1, wherein the buffer amplifying circuit comprises:

a first buffer amplifier, having a negative input terminal and an output terminal coupled to one another, and a positive input terminal coupled to the second source/drain of the first transistor;

a fourth transistor, having a gate and a first source/drain respectively coupled to the gate of the first transistor and the output terminal of the first buffer amplifier;

a second capacitor, having one end coupled to a second source/drain of the fourth transistor, and another end grounded;

a second buffer amplifier, having a negative input terminal and an output terminal coupled to one another, and a positive input terminal coupled to the second source/drain of the fourth transistor;

a fifth transistor, having a gate coupled to the gate of the first transistor, and a first source/drain coupled to an output terminal of the second buffer amplifier; and a third capacitor, having one end coupled to a second source/drain of the fifth transistor, and another end coupled to the ground.

8. The signal controlling circuit as claimed in claim 7, wherein the fourth transistor is an NMOS transistor, and the fifth transistor is a PMOS transistor.

9. The signal controlling circuit as claimed in claim 1, wherein the second comparison feedback unit comprises:

a first comparator, having a positive input terminal receiving one of the scan signals other than the scan signals received by the first comparison feedback unit, and a negative input terminal receiving a threshold voltage, and configured to output a third comparison signal; and a buffer amplifier module, coupled to the first comparator, for receiving the third comparison signal and generating the second calculation signal.

10. The signal controlling circuit as claimed in claim 1, wherein the calculation unit comprises:

a second operational amplifier, with a positive terminal and a negative terminal respectively receiving the second calculation signal and the first calculation signal, and configured to output a third calculation signal; and a comparator, having a positive terminal receiving the third calculation signal, and a negative terminal receiving a triangle-wave signal, and configured to output the control signal.

11. The signal controlling circuit as claimed in claim 10, wherein the second operational amplifier is a high gain amplifier.

12. The signal controlling circuit as claimed in claim 10, wherein the comparator is a pulse width modulation comparator.

13. A flat panel display, comprising:

a display panel, having a plurality of scan lines and a plurality of the pixels, wherein each of the scan lines is coupled to the corresponding pixels;

a scan driving circuit, coupled to the display panel, for generating a first scan signal and a second scan signal, wherein the first scan signal enables two of the scan lines, and the second scan signal enables one of the scan lines other than the two scan lines enabled by the first scan signal; and a signal control circuit, for receiving a plurality of scan signals generated when the scan lines are enabled, and determining whether or not to enable a control signal every a predetermined time according to the scan signals, wherein when the control signal is enabled, one of the scan signals is enabled, wherein the signal control circuit comprises:

a first comparison feedback unit, coupled to two of the scan lines, for receiving a corresponding scan signals and outputting a first calculation signal, wherein the first comparison feedback unit comprises:

a logic circuit, for receiving two of the scan signals and outputting a logic signal; and a buffer amplifier module, coupled to the logic circuit, for receiving the logic signal and generating the first calculation signal, wherein the buffer amplifier module comprises:

a first transistor, having a first source/drain receiving a voltage source and a gate receiving the logic signal;

a second transistor, having a first source/drain and a second source/drain respectively receiving a voltage signal and the voltage source, and a gate being coupled to the gate of the first transistor;

a third transistor, having a first source/drain receiving the voltage signal, a gate and a second source/drain respectively coupled to the gate and a second source/drain of the first transistor;

a first capacitor, having one end coupled to the second source/drain of the first transistor and another end coupled to the ground;

a first operational amplifier, having a positive input terminal coupled to the second source/drain of the first transistor, and a negative input terminal receiving the voltage signal; and a buffer amplifying circuit, disposed between the first transistor and the first operational amplifier, for delaying transmitting time of signals;

a second comparison feedback unit, coupled to one of the scan lines other than the two scan lines coupled to the first comparison feedback unit, for receiving a corresponding scan signal and outputting a second calculation signal; and a calculation unit, for receiving the first calculation signal and the second calculation signal, and outputting the control signal.

14. The flat panel display as claimed in claim 13, wherein the first scan driving signal is used for driving last two rows of the scan lines.

15. The flat panel display as claimed in claim 13, wherein the control signal enables one of the scan lines other than the scan lines enabled by the first scan driving signal.

16. The flat panel display as claimed in claim 13, wherein the logic circuit comprises:

a first comparator, having a positive input terminal receiving one of the scan signals and a negative input terminal receiving a threshold voltage, and configured to output a first comparison signal;

a second comparator, having a positive input terminal receiving the other one of the scan signals and a negative input terminal receiving the threshold voltage, and configured to output a second comparison signal;

an inverter, coupled to an output terminal of the second comparator, for outputting an inverted second comparison signal; and an AND gate, for receiving the first comparison signal and the inverted second comparison signal, and outputting the logic signal to the buffer amplifier module.

17. The flat panel display as claimed in claim 13, wherein the first operational amplifier is a low gain amplifier.

18. The flat panel display as claimed in claim 13, wherein the first transistor is an NMOS transistor, and the second transistor and the third transistor are PMOS transistors.

19. The flat panel display as claimed in claim 13, wherein the buffer amplifying circuit comprises:

a first buffer amplifier, having a negative input terminal and an output terminal coupled to one another, and a positive input terminal coupled to the second source/drain of the first transistor;

a fourth transistor, having a gate and a first source/drain respectively coupled to the gate of the first transistor and the output terminal of the first buffer amplifier;

a second capacitor, having one end coupled to a second source/drain of the fourth transistor, and another end grounded;

a second buffer amplifier, having a negative input terminal and an output terminal coupled to one another, and a positive input terminal coupled to the second source/drain of the fourth transistor;

a fifth transistor, having a gate coupled to the gate of the first transistor, and a first source/drain coupled to an output terminal of the second buffer amplifier; and a third capacitor, having one end coupled to a second source/drain of the fifth transistor, and another end coupled to the ground.

20. The flat panel display as claimed in claim 19, wherein the fourth transistor is an NMOS transistor, and the fifth transistor is a PMOS transistor.

21. The flat panel display as claimed in claim 13, wherein the second comparison feedback unit comprises:

a first comparator, having a positive input terminal receiving one of the scan signals other than the scan signals received by the first comparison feedback unit, a negative input terminal receiving a threshold voltage, and configured to output a third comparison signal; and a buffer amplifier module, coupled to the first comparator, for receiving the third comparison signal and generating the second calculation signal.

22. The flat panel display as claimed in claim 13, wherein the calculation unit comprises:

a second operational amplifier, having a positive terminal and a negative terminal respectively receiving the second calculation signal and the first calculation signal, and configured to output a third calculation signal; and a comparator, having a positive terminal receiving the third calculation signal, and a negative terminal receiving a triangle-wave signal, and configured to output the control signal.

23. The flat panel display as claimed in claim 22, wherein the second operational amplifier is a high gain amplifier.

24. The flat panel display as claimed in claim 22, wherein the comparator is a pulse width modulation comparator.

* * * * *